US006933670B2

(12) United States Patent
Yaniv

(10) Patent No.: US 6,933,670 B2
(45) Date of Patent: Aug. 23, 2005

(54) FLAT MULTI-SPECTRAL LIGHT SOURCE

(75) Inventor: Zvi Yaniv, Austin, TX (US)

(73) Assignee: Si Diamond Technology, Inc., Austin, TX (US)

( * ) Notice: Subject to any disclaimer, the term of this patent is extended or adjusted under 35 U.S.C. 154(b) by 79 days.

(21) Appl. No.: 10/349,899

(22) Filed: Jan. 23, 2003

(65) Prior Publication Data

US 2003/0137228 A1 Jul. 24, 2003

Related U.S. Application Data

(60) Provisional application No. 60/351,331, filed on Jan. 23, 2002.

(51) Int. Cl.[7] ..... H01J 1/62

(52) U.S. Cl. ..... 313/495; 313/112

(58) Field of Search ..... 313/495–497, 313/112, 113; 315/169.1, 169.3

(56) References Cited

U.S. PATENT DOCUMENTS 5,721,561 A * 2/1998 Kishino et al. ..... 345/75.2
6,417,892 B1 * 7/2002 Sharp et al. ..... 348/742

* cited by examiner

*Primary Examiner*—Joseph Williams
(74) *Attorney, Agent, or Firm*—Winstead Sechrest & Minick

(57) ABSTRACT

Cold cathodes are used as field emitters within a multi-spectral light source, which is flat and compact. With the use of filters, very narrow and tunable light wavelengths can be achieved from a single lamp having a large selection of spectral behavior.

9 Claims, 1 Drawing Sheet

FLAT MULTI-SPECTRAL LIGHT SOURCE

This application claims priority to U.S. Provisional Application Ser. No. 60/351,331 field Jan. 23, 2002.

TECHNICAL FIELD

The present invention relates in general to sources of light energy, and in particular, to a light source having a tuned spectrum of wavelengths.

BACKGROUND INFORMATION

Just about everything humans do requires their sense of vision. Since the human eye reacts to the visible wavelengths, sources of light, such as the light from the sun and artificial lighting, are required, since the ability to see an object requires that light be reflected off of such object towards the eyes of a human.

Further, there are many applications where a desired light color, or wavelength, is needed or desired for a particular application. For example, it is often desired to have various colored lights for entertainment applications, such as within music concerts or stage plays. On another end of the application spectrum, particular light wavelengths are needed in blood analyzers. What is evident in all such applications is that a desired spectrum of light needs to be created. It would further be desirable to have a light source that is tunable so that a plurality of light wavelengths can be alternatively projected.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

In the following description, numerous specific details are set forth such as specific field emitters or phosphors, etc. to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted in as much as such details are not necessary to obtain a complete understanding of the present invention and are within the skills of persons of ordinary skill in the relevant art.

Figure 1:
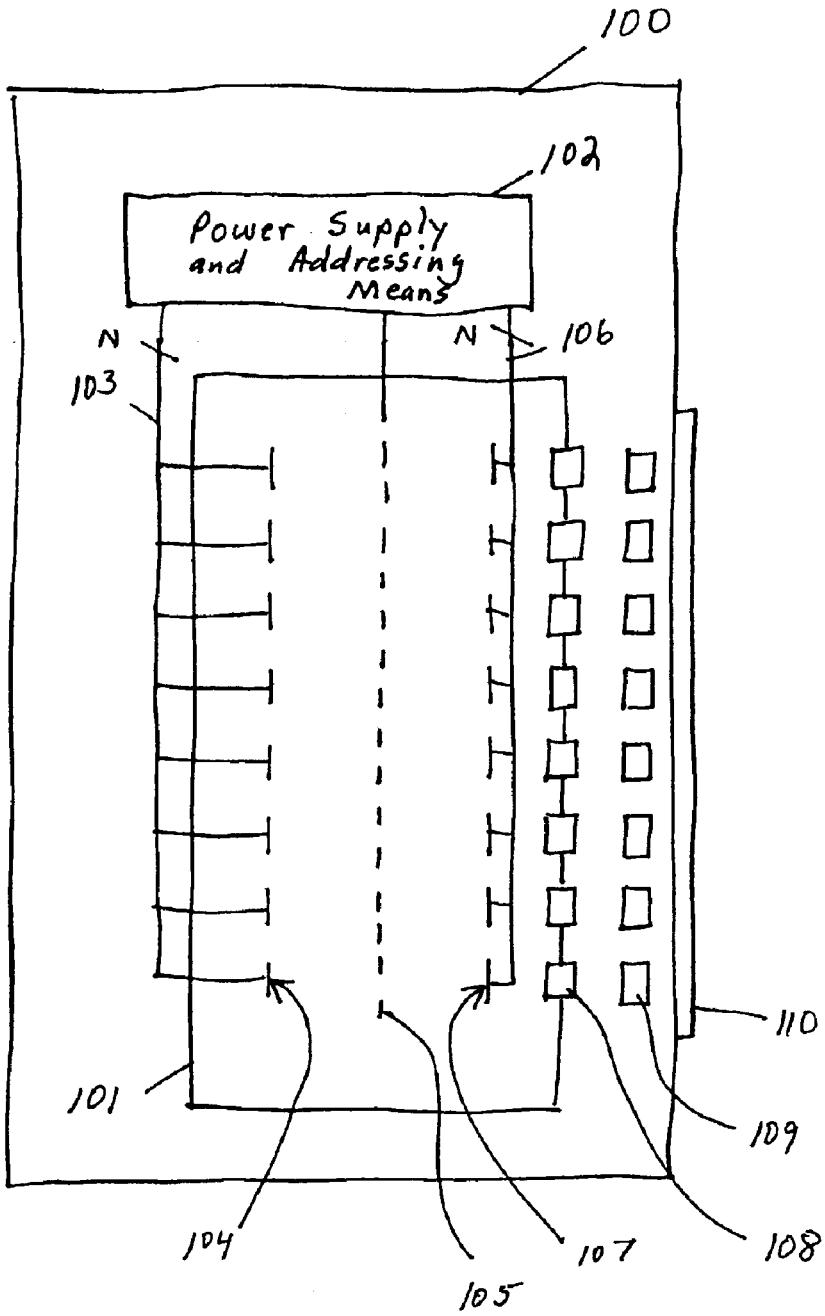
FIG. 1 illustrates a block diagram of an embodiment of the present invention.
Figure 1:
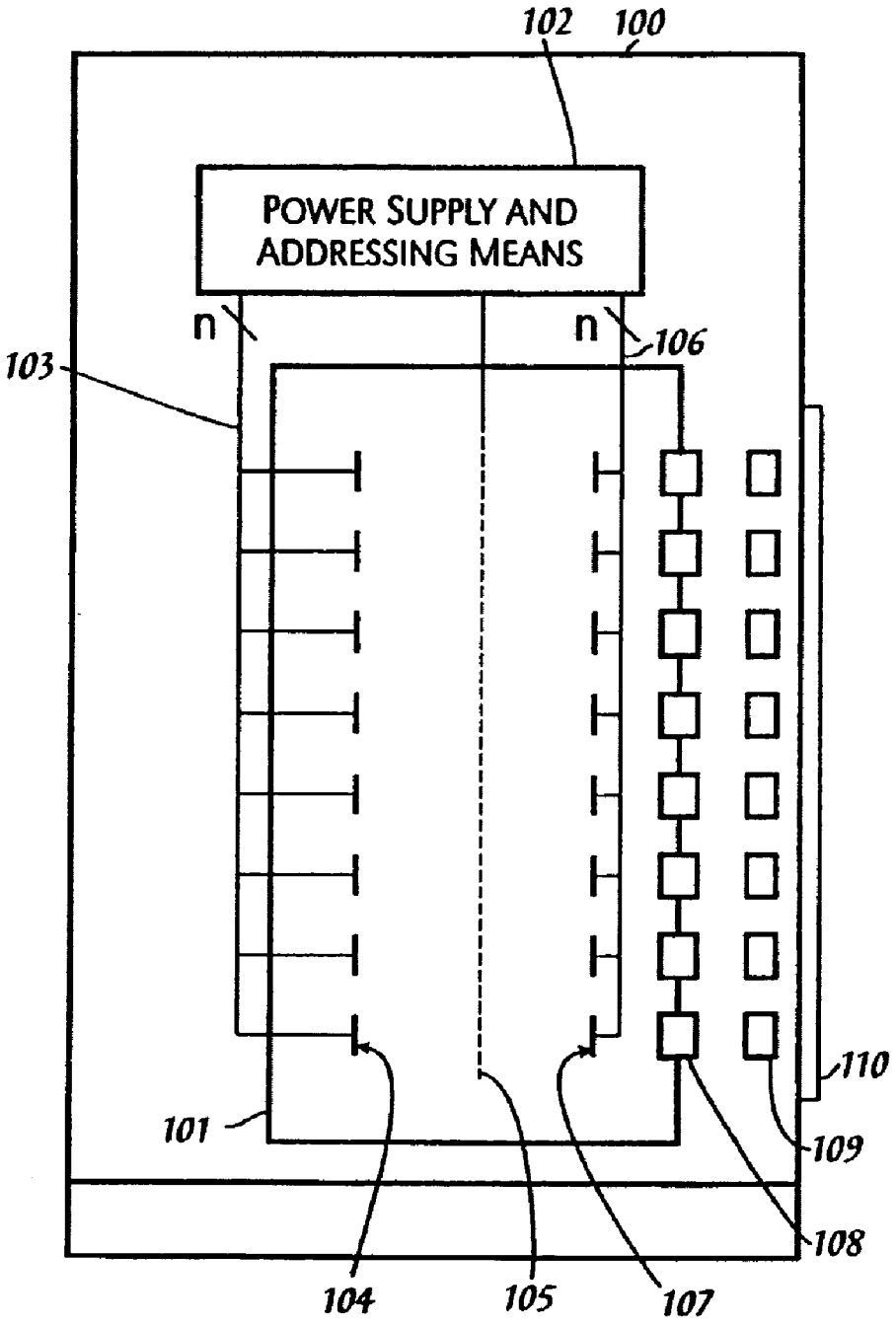

Referring to FIG. 1, there is illustrated light source 100 configured in accordance with an embodiment of the present invention. Enclosure 101 encloses the light producing elements along with elements coated with various types of phosphors for emitting different wavelengths of light. Enclosure 101 may have a pressure near a vacuum level. Elements 104 may be a plurality of cold cathodes, which will assist in device 100 being very flat and compact. Cold cathodes 104 can be comprised of any well-known field emission material, such as metal tips, carbon films, carbon nanotubes, etc. Selection of the various ones of the field emitters 104 is performed through N lines 103, which are coupled to power supply and addressing means 102, which is capable of addressing through well-known means any one or more of field emitters 104 by selection of one or more of the N lines 103. Additionally, an optional gate electrode 105 may be included to assist in extraction of electrons from field emitters 104 and/or focusing of such electron beams towards selected ones of phosphor-coated substrates 107. Each of the plurality of phosphor-coated substrates 107 may be coupled through line 106 to power supply and addressing means 102 if an electrode is associated with each of the substrates 107. This might be the case where each of the phosphor-coated substrates 107 comprise the anode, while the field emitters 104 each comprise the cathode for a diode field emission device. Of course, the inclusion of a gate electrode 105 would make such a device a triode field emission device.

The power supply and addressing means 102 will provide an ability to create the electric fields required to extract electrons from the field emitters so that they are emitted towards the phosphor coated substrates.

Each of the phosphor coated substrates 107 may have coated thereon a different phosphor so that each one emits a different wavelength of light. Exemplary phosphor types are $Y_2O_3$:Eu for a red color, $Y_2SiO_5$:Tb for a green color, and ZnS:Ag,Al for a blue color. There are other phosphors for red, green and blue that have slightly different properties, such as slightly different shades of color, intensity, etc. Selection of which phosphors to include would be up to the designer of the particular lamp 100 to be manufactured.

Further included are light filters 109 for each of the plurality of phosphor-coated substrates 107. As a selected one of the phosphors 107 is bombarded by its corresponding field emitter 104, it will emit light photons of the desired wavelength. These photons will pass through the corresponding filter 109 to further narrow the spectral band of the emitted light. Alternatively, such filters 109 may be tunable filters to even better define the spectral width. For example, one could use a liquid crystal (LC) tunable filter, such as disclosed in *C. Hoyt, Biophotonics Int.*, July/August 1996, pages 49–51, which is hereby incorporated by reference herein. Such filters are a stack of LC cells, one on top of the other. The stack uses constructive interference of light from each of the cells to act as a filter. A bias can be placed across each of the cells in the stack. By changing the bias of the cells, one can change the index of refraction of the LC material. This changes the interference properties of the stack and therefore tunes the filter to create the interference at different wavelengths.

Windows 108 are included for passing such photons from the phosphor coated substrates 107 to the corresponding filters 109. Yet still further, window 110 may be included within an enclosure of the lamp 100 for passing the light therethrough.

The result of the foregoing lamp 100 is that very accurate and narrow light wavelength emissions can be achieved with a compact design. The different phosphors can be used singularly or in combination with each other to emit the desired wavelength, and along with the tunable filters 109, can be further narrowed to a very exacting degree. Such tunable filters 109 can also be used to assist in combining wavelengths from a plurality of phosphor coated substrates.

Although the present invention and its advantages have been described in detail, it should be understood that various changes, substitutions and alterations can be made herein without departing from the spirit and scope of the invention as defined by the appended claims.

What is claimed is:

1. A light source comprising:

a field emission cathode;

a phosphor coated substrate; and a tunable light filter, wherein photons emitted from the phosphor as a result of bombardment from electrons emitted from the field emission cathode are passed through the tunable light filter.

2. The light source as recited in claim 1, wherein the tunable light filter is configured to narrow a wavelength of the photons emitted from the phosphor.

3. A light source comprising:

a first field emission cathode;

a second field emission cathode;

a first phosphor coated substrate positioned to receive electrons emitted from the first field emission cathode;

a second phosphor coated substrate positioned to receive electrons emitted from the second field emission cathode;

a first tunable light filter positioned to pass therethrough photons emitted from the first phosphor; and a second tunable light filter positioned to pass therethrough photons emitted from the second phosphor, wherein the first and second tunable filters are configured to pass their respective photons at different wavelengths from each other.

4. The light source as recited in claim 3, further comprising circuitry for selecting activation of one or both of the first and second field emission cathodes to emit electrons.

5. The light source as recited in claim 4, wherein if the first field emission cathode is activated and the second field emission cathode is not activated, then photons of a first wavelength are emitted from the light source.

6. The light source as recited in claim 5, wherein if the second field emission cathode is activated and the first field emission cathode is not activated, then photons of a second wavelength are emitted from the light source, wherein the first and second wavelengths are different.

7. The light source as recited in claim 6, wherein if the first field emission cathode is activated and the second field emission cathode is activated, then photons of a third wavelength are emitted from the light source, wherein the first, second, and third wavelengths are different from each other.

8. A method of operating a light source comprising the steps of:

providing a first field emission cathode;

providing a second field emission cathode;

providing a first phosphor coated substrate;

providing a second phosphor coated substrate;

providing a first tunable light filter;

providing a second tunable light filter;

providing first circuitry for generating a first electric field to cause an emission of electrons from the first field emission cathode;

providing second circuitry for generating a second electric field to cause an emission of electrons from the second field emission cathode; and selecting one or both of the first and second circuitry for generating, wherein if the first field emission cathode is activated by the generating of the first electric field and the second field emission cathode is not activated, then photons are emitted from the first phosphor and pass through the first tunable light filter creating a first wavelength of light produced by the light source.

9. The method as recited in claim 8, wherein if the first field emission cathode is activated by the generating of the first electric field and the second field emission cathode is activated by the generating of the second electric field, then photons are emitted from the first and second phosphors and pass through the first and second tunable light filters creating a second wavelength of light produced by the light source.

* * * * *

UNITED STATES PATENT AND TRADEMARK OFFICE

CERTIFICATE OF CORRECTION

PATENT NO. : 6,933,670 B2
APPLICATION NO. : 10/349899
DATED : August 23, 2005
INVENTOR(S) : Zvi Yaniv It is certified that error appears in the above-identified patent and that said Letters Patent is hereby corrected as shown below:

Drawings:
The title page showing the print figure should be deleted, and replaced with the attached amended title page.
Drawing sheet, consisting of Fig. 1, should be deleted and replaced with the drawing sheet, consisting of Fig. 1, as shown on the attached page.

Column 1, line 4, replace “field” with --filed--.

Signed and Sealed this

Eleventh Day of July, 2006

JON W. DUDAS
*Director of the United States Patent and Trademark Office*

(12) United States Patent
Yaniv

(10) Patent No.: US 6,933,670 B2
(45) Date of Patent: Aug. 23, 2005

(54) FLAT MULTI-SPECTRAL LIGHT SOURCE

(75) Inventor: Zvi Yaniv, Austin, TX (US)

(73) Assignee: Si Diamond Technology, Inc., Austin, TX (US)

( * ) Notice: Subject to any disclaimer, the term of this patent is extended or adjusted under 35 U.S.C. 154(b) by 79 days.

(21) Appl. No.: 10/349,899

(22) Filed: Jan. 23, 2003

(65) Prior Publication Data

US 2003/0137228 A1 Jul. 24, 2003

Related U.S. Application Data

(60) Provisional application No. 60/351,331, filed on Jan. 23, 2002.

(51) Int. Cl.[7] ..... H01J 1/62

(52) U.S. Cl. ..... 313/495; 313/112

(58) Field of Search ..... 313/495–497, 313/112, 113; 315/169.1, 169.3

(56) References Cited

U.S. PATENT DOCUMENTS 5,721,561 A * 2/1998 Kishino et al. ..... 345/75.2
6,417,892 B1 * 7/2002 Sharp et al. ..... 348/742

* cited by examiner

*Primary Examiner*—Joseph Williams
(74) *Attorney, Agent, or Firm*—Winstead Sechrest & Minick

(57) ABSTRACT

Cold cathodes are used as field emitters within a multi-spectral light source, which is flat and compact. With the use of filters, very narrow and tunable light wavelengths can be achieved from a single lamp having a large selection of spectral behavior.

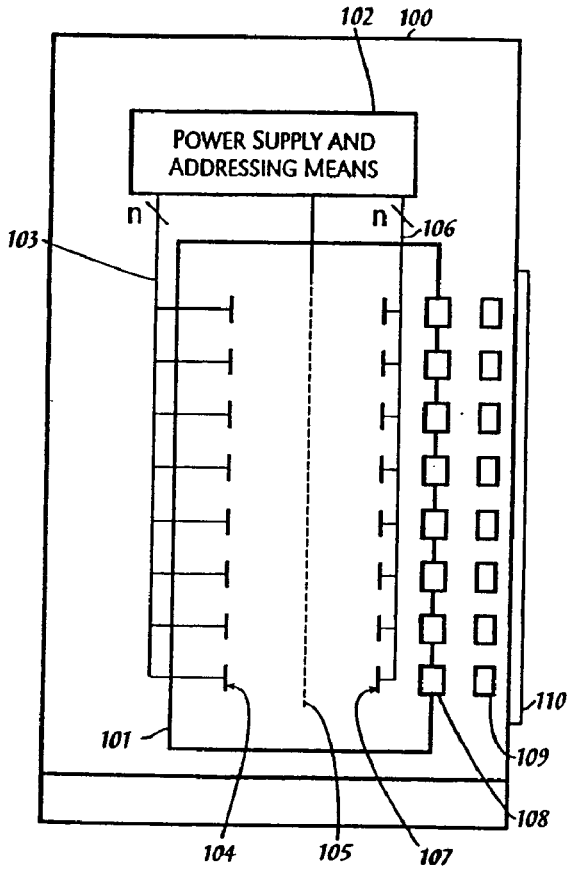

9 Claims, 1 Drawing Sheet